US006328049B1

(12) United States Patent
Kim

(10) Patent No.: US 6,328,049 B1
(45) Date of Patent: Dec. 11, 2001

(54) COLLAPSIBLE TENT

(76) Inventor: Gyeong S. Kim, 12 Tunley Close, Endeavor Hills, VIC (AU), 3802

( * ) Notice: Subject to any disclaimer, the term of this patent is extended or adjusted under 35 U.S.C. 154(b) by 0 days.

(21) Appl. No.: 09/625,050

(22) Filed: Jul. 24, 2000

(51) Int. Cl.[7] ..... E04H 15/40
(52) U.S. Cl. ..... 135/126; 135/128; 135/143
(58) Field of Search ..... 135/125–128, 135/133, 143

(56) References Cited

U.S. PATENT DOCUMENTS

| | | | | |
|---|---|---|---|---|
| 3,476,127 | | 11/1969 | Holt . | |
| 3,675,667 | | 7/1972 | Miller . | |
| 4,520,835 | | 6/1985 | Moeller . | |
| 4,823,822 | | 4/1989 | Maya . | |
| 4,958,652 | | 9/1990 | Maya . | |
| 5,163,461 | * | 11/1992 | Ivanovich | 135/104 |
| 5,249,592 | | 10/1993 | Springer et al. . | |
| 5,301,705 | | 4/1994 | Zheng . | |
| 5,337,772 | * | 8/1994 | Habchi | 135/104 |
| 5,360,028 | | 11/1994 | Jasin . | |
| 5,361,794 | | 11/1994 | Brady . | |
| 5,385,165 | | 1/1995 | Hazinski et al. . | |
| 5,396,917 | * | 3/1995 | Hazinski | 135/104 |
| 5,407,291 | | 4/1995 | Hazinski et al. . | |
| 5,411,046 | | 5/1995 | Wan . | |
| 5,439,017 | | 8/1995 | Brown . | |
| 5,467,794 | | 11/1995 | Zheng . | |
| 5,816,278 | * | 10/1998 | Kim | 135/126 |

* cited by examiner

*Primary Examiner*—Carl D. Friedman
*Assistant Examiner*—L. B. Porterie
(74) *Attorney, Agent, or Firm*—John K. Park; Park & Sutton LLP

(57) ABSTRACT

A collapsible tent comprising a closed loop resilient coilable tent member, the member being distorted to form at least three tent support nooses, each tent support noose adjoining the other tent support nooses along at least a portion of its perimeter. The tent support noose having a perimeter substantially the same as that of the other tent support nooses and a tent membrane attached to at least a portion of the perimeter of the tent support noose and extending between the opposing portions of the tent support noose to restrain the tent support noose. A common adjoining region loop member secured within the tent membrane.

A collapsible hat includes a closed loop resilient coilable hat member, and a hat membrane attached to at least a portion of the perimeter of the hat member. The hat member forms a common adjoining tent region for the tent support nooses.

28 Claims, 14 Drawing Sheets

FIG. 1c(2)
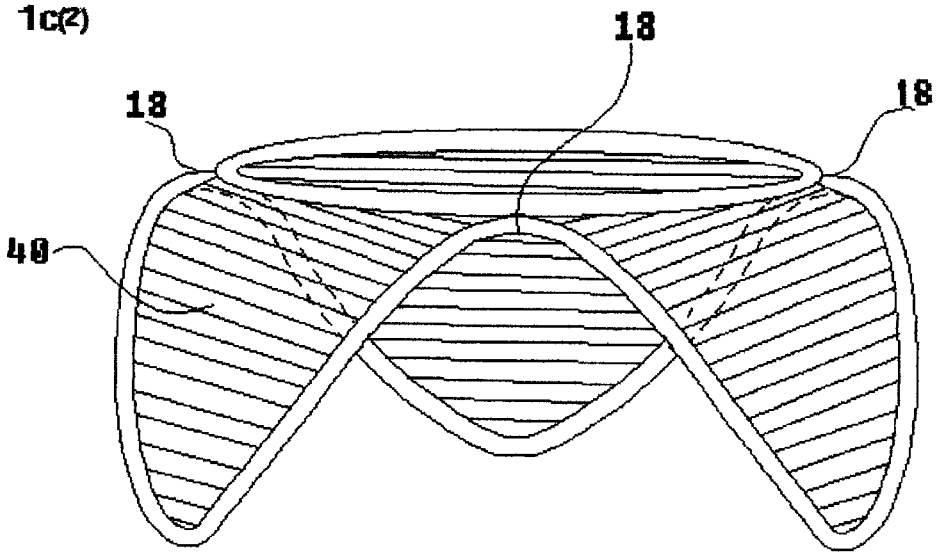
FIG.1c(3)
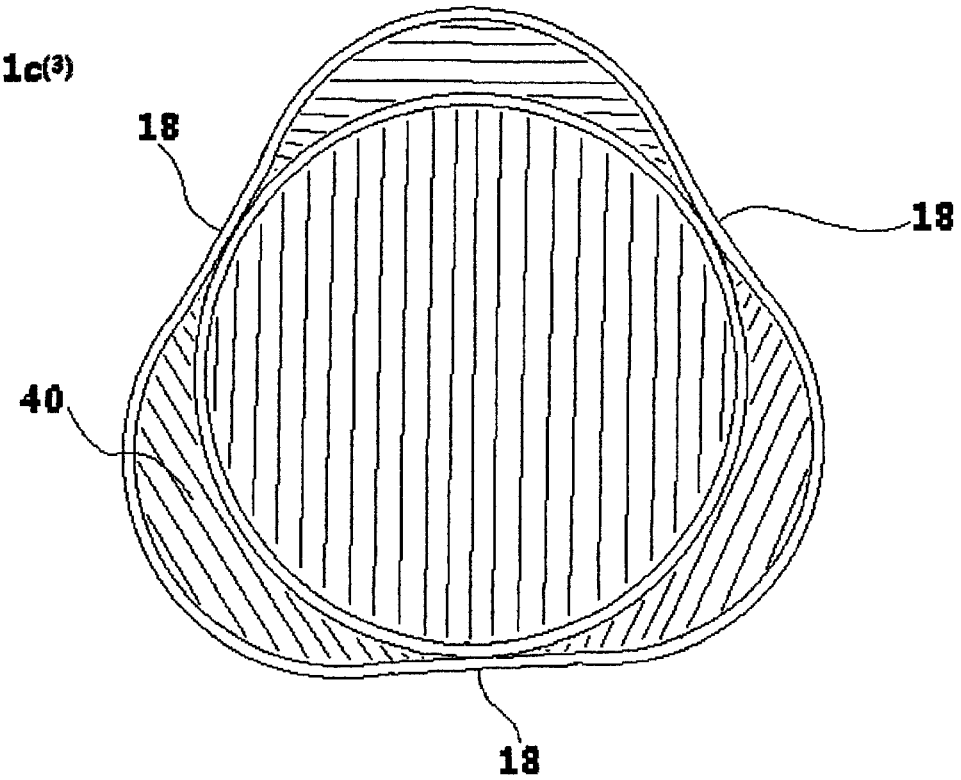

COLLAPSIBLE TENT

BACKGROUND OF THE INVENTION

The present invention relates generally to tents and sunshelters and in particular to collapsible portable tents, mosquito nets and sunshelters.

Sun shelters and tents are becoming increasingly popular. One of the reasons for this popularity is the increasing awareness by the public of the detrimental effects of the sunshine particularly, the increasing risk and incidence of skin cancer.

Warmer climates also create the need for an additional cover over a tent to prevent the tremendous buildup of heat that can occur from the sun shining directly on the surface of the tent walls and top.

Collapsible tents are available in numerous designs. Tents with rigidly constructed supports are known; some even include covers for the prevention of condensation on the tent walls. These covers also could serve to prevent the sun from shining directly on the tent. A disadvantage of the condensation prevention covers is that they are specifically designed for preventing condensation from reaching the surface walls of the tent. The color, density and type of fabric used may not be optimal for preventing heat build up from the sun.

Another cause of heat build up within the tent is the totally enclosed design of many tents. The walls, roof and floor of a tent form a sealed interior that does not provide any air circulation within the tent. An example is U.S. Pat. No. 5,816,278 where the floor and walls are substantially a solid membrane and the tent support loops meet at a single apex point. Doors or windows may be available in the tent, but these are often small and provide minimal circulation of air that will dissipate the heat build up within the tent.

With the substantial increase in outdoor activities such as camping, many campers utilize tents as temporary shelter or protection from the sun. Conventional tents typically include a weather resistant flexible membrane, which is supported by polls and anchored to the ground by rope lines. A major problem with conventional tents is the complexity of erecting and collapsing them. To erect a tent, a user must first unfold and lay out the tent membrane on the ground, plant anchoring points for the tent on the ground, attach anchoring ropes to the anchor points, plant a support pole on the ground to support the apex of the tent, lift the tent membrane off the ground and place its apex on the support poll, and restrain the tent membrane by adjusting the tension of the rope lines. In collapsing the tent, the user must disassemble the anchors and the rope lines, fold the tent and fit the membrane, the rope lines and the support pole in a carrying case.

To overcome the disadvantages of such conventional tents, some tent manufacturers have provided collapsible tents with resilient supports embedded in the tent membrane to alleviate the need for a support pole and anchoring rope lines. Such collapsible tents can be folded and placed in a case for transport.

However, a disadvantage of such tents is that the resilient supports consist of several separate support members which in most cases a user must carefully attach to another at several points in order to define the structure of the tent. As such, the user must spend time learning how to attach the tent members together and attach and detach the members every time the tent is erected. Further, the use of many tent members increases the cost of manufacturing, purchase and maintenance of the tent over the lifetime of the tent. Yet another disadvantage of such tents is difficulty of collapsing the tents into a small assembly. The base of the tent adds even more bulk and additional steps of folding. Typically, the user must twist and turn the resilient supports to fold them. This action requires substantial expenditure of time and energy, as the resilient supports are usually quite stiff in order to maintain the structural integrity of the tent.

Various forms of sunshades and sun protectors are also available. Sunshades include umbrellas, canopies and folded corrugated cardboard. Most of these are slightly collapsible from their fully unfolded arrangement. The present designs still are bulky or heavy, even when in a folded condition. None of the existing devices combine a collapsible tent or shelter that also includes a collapsible hat cover.

Therefore, because of the deficiencies in each of the presently available tent and sun protector products, there is a need for a collapsible tent that also includes a collapsible hat with an open bottom for air circulation to prevent heat build up. The collapsible tent should be self-erecting without the need for assembly. The collapsible tent also needs to be lightweight and coil into a small configuration for storage and transport.

SUMMARY OF THE INVENTION

The present invention satisfies these needs. In one embodiment, the present invention provides a collapsible tent comprising a closed loop resilient coilable tent member, the member being distorted to form at least three support nooses. (In this application, the term "noose" is used to mean "loop" to better differentiate between two items: a closed loop resilient coilable tent member and support loops. Thereupon, support loops will be referred as support nooses.) Configurations of four, five, six or more support nooses are possible.

Each support nooses adjoins the other tent support nooses along a portion of its perimeter with the tent support nooses having a common adjoining tent region. Each support noose has a perimeter substantially the same in shape or size as that of the other tent support nooses and a membrane attached to at least a portion of the perimeter of the support noose. The tent membrane extends between the opposing portions of the support noose to restrain the support noose. The tent further comprises a means for restraining attached to at least a portion of the perimeter of each support noose and extending between the tent support nooses to restrain the tent support nooses in relation to one another. The means for restraining may be a cord, line, wire, strap, tie, pole, membrane or other similar means. The cord or line is much lighter, less cumbersome, longer lasting and less expensive to manufacture than a fabric floor means for restraining, typically found on tents.

When the tent is expanded, the tent support nooses are in spaced relation to one another around the common adjoining tent region and are restrained by the tent membranes and the means for restraining. The common adjoining tent region is substantial in area, unlike some prior designs where the tent support nooses meet in an apex and the common adjoining tent region approximates a point. The common adjoining tent region forms a roof of the tent and the tent membranes define walls of the tent. A net fabric may also form a portion of the walls or entrance of the tent and serve to keep bugs out and increase the airflow to the interior of the tent. Since the common adjoining tent region is substantial in area, a roof distinctive from the walls of the tent is created in many of the variations of the present invention. When the tent is fully collapsed, the tent support nooses form overlapping loops over one another that are coiled. A common adjoining region loop member can be secured within the tent membrane. The common adjoining region loop member is planar in form and serves to support the tent membrane in the common adjoining region. An additional hat membrane may be present that is positioned on top of the tent membrane and provides an air pocket that reduces the heat build up within the collapsible tent.

Preferably, each support noose further comprises tightening means along at least a portion of its perimeter to allow detaching the tent membrane of the support noose from a portion of the support noose to unrestrain the support noose when collapsing the tent. This allows effortless folding of the tent support nooses in collapsing the tent. More preferably, each support noose further comprises attachment means along at least a portion of its perimeter to allow detaching the means for restraining from a portion of said support noose to unrestrain said support noose when collapsing the tent.

Additionally, a hat may be added to the basic tent structure. The hat positioned above the collapsible tent provides protection from the sun. The hat is also a closed loop resilient coilable hat member and a hat membrane attached to at least a portion of the perimeter of the hat member. The hat may be a separate closed loop resilient coilable hat member or may be continuous with the tent support nooses. The hat includes a means for attaching a portion of the perimeter of the hat member and the tent support nooses to secure the hat to the tent support nooses. The means for attaching may be Velcro, ties, snaps, hooks, zippers or similar methods. The hat member forms a common adjoining tent region for the tent support nooses. The hat member may be distorted to form hat support nooses with the hat support nooses joining at a center area. The center area may take a variety of geometric shapes including; square, diamond, triangle and a point. In the preferred embodiment each hat support noose adjoins and attaches to the highest point of the perimeter of a tent support noose.

When the tent is expanded, the tent support nooses are in spaced relation to one another around the hat member and restrained by the means for restraining. The hat member forms a roof and the tent membranes of the tent support nooses create the walls of the tent.

The collapsible tent thus overcomes the disadvantages of the prior art by providing a collapsible hat for added sun protection and minimizing of heat build up within the collapsible tent. An open bottom of the collapsible hat for air circulation to also prevents heat build up. The collapsible tent is self-erecting without the need for assembly. The collapsible tent is also lightweight and coils into a small configuration for storage and transport.

BRIEF DESCRIPTION OF THE DRAWINGS

These and other features, aspects, and advantages of the present invention will become better understood with regard to the following description, appended claims, and accompanying drawings which illustrate examples of the invention, where:

FIG. 1*c* (1) and FIG. 1*c*(3) show the top plan view of the embodiments shown on FIG. 1*c* and FIG. 1*c*(2), respectively.

FIGS. 1*da* though FIG. 1*de* show the steps for coiling of the loops for storage.

FIG. 3*a* shows a perspective view of the tent member with the common adjoining region loop member in the shape of an ellipse.

FIG. 3*d*-1*a* through 3*d*-1*d* illustrate top views of the steps in folding of the tent.

FIG. 6*c*-3 show the steps for coiling of the loops and nooses for storage.

FIG. 6*c* illustrates the hat in the form of four nooses meeting at a square shape.

DESCRIPTION

Figure 1A:
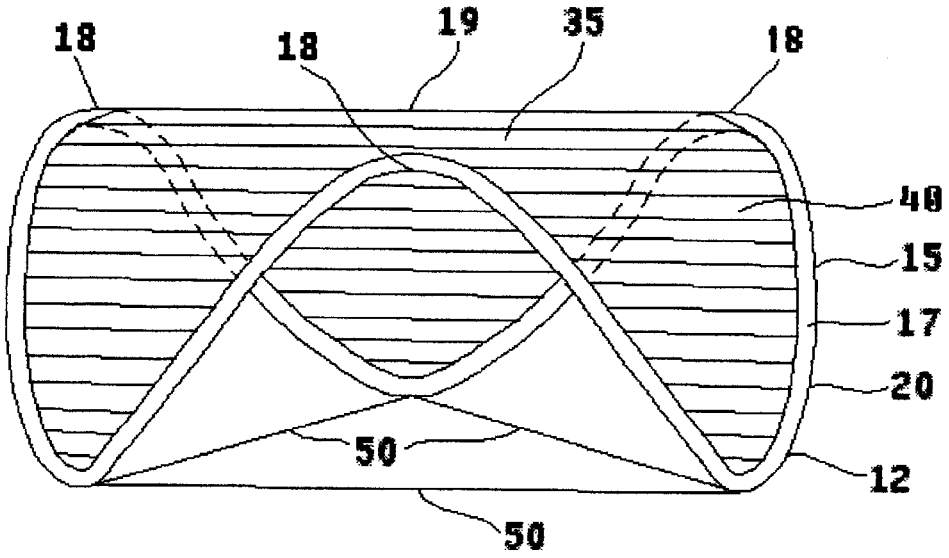
FIG. 1*a* through FIG. 1*c*, and FIG. 1*c*(2) show perspective views of embodiments of the collapsible tent.
Figure 1A:
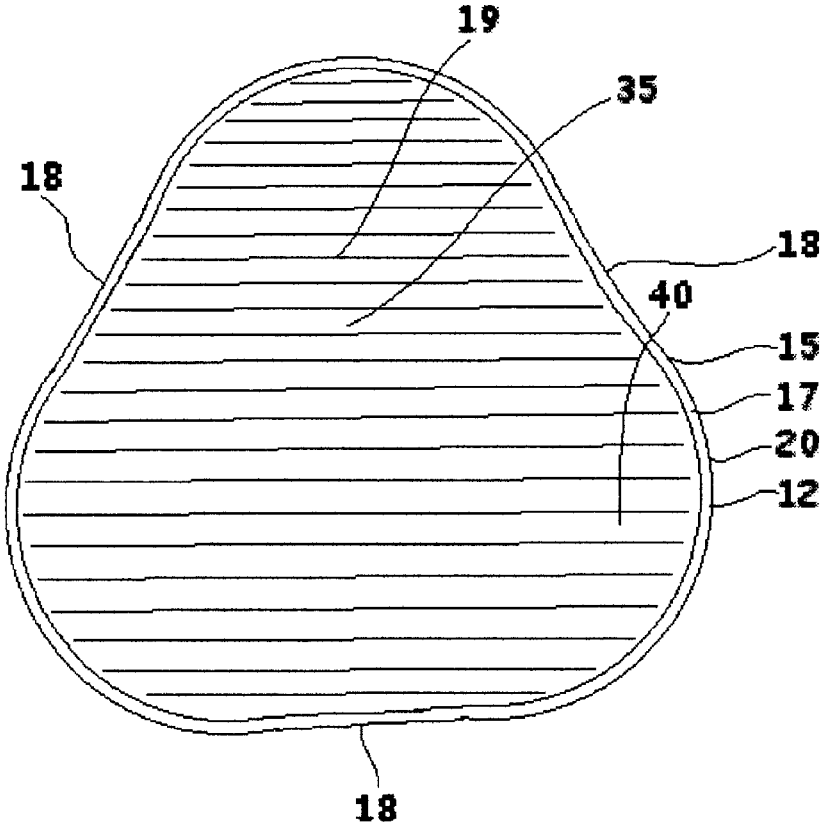

Referring to FIG. 1*a*-1*d* and FIG. 2, a preferred embodiment of a collapsible tent 10 according to the present invention is shown. The collapsible tent 10 includes a tent member 12 that is formed by a closed loop resilient coilable tent member 15. The collapsible tent 10 may also include a second closed loop resilient coilable hat member 16. Tent member 12 having a perimeter 17 is distorted to form at least three tent support nooses 20. Each tent support nooses 20 has a high point 18 along its perimeter 17. The area that intersects or joins the high point 18 of each tent support nooses 20 approximately defines the boundary 19 of a common adjoining tent region 35. The common adjoining tent region 35 is substantial in size and the tent support nooses 20 do not meet at a single point, thus differentiating the design from other designs where the tent support nooses 20 peak at a single apex point. A separate closed loop resilient coilable common adjoining region loop member 36 can be included. The common adjoining tent region loop member 36 substantially follows the boundary 19 of the common adjoining tent region 35. The common adjoining region loop member 36 is secured within the tent membrane 40. There is no separate hat membrane 41 when the common adjoining region loop member 36 is used, as the common adjoining region loop member 36 is secured within the tent membrane 40. The common adjoining region loop member 36 may be shaped as an ellipse, oval, circular, rectangular, square, triangle and the like. Other shapes are also possible as is recognized by practitioners in the art. Alternately the tent support nooses 20 can be further distorted so that a portion of each tent support noose 20 follows the boundary 19 of the common adjoining tent region 35. As such, each tent support noose 20 adjoins the other tent support nooses along at least a portion of its perimeter 17, forming a common adjoining tent region 35. The tent support nooses 20 may cross over along a portion of the perimeter 17. A common adjoining tent region 35 is formed at the top of the tent where the perimeter 17 of the tent support nooses 20 crosses over itself. Alternately, the perimeter 17 may form partial loops with the closed loop resilient member 15 never crossing over upon itself.

The perimeter length of each tent support noose 20 is substantially the same as that of the other tent support nooses 20 to provide a symmetrical structure for the collapsible tent 10.

Figure 1B:
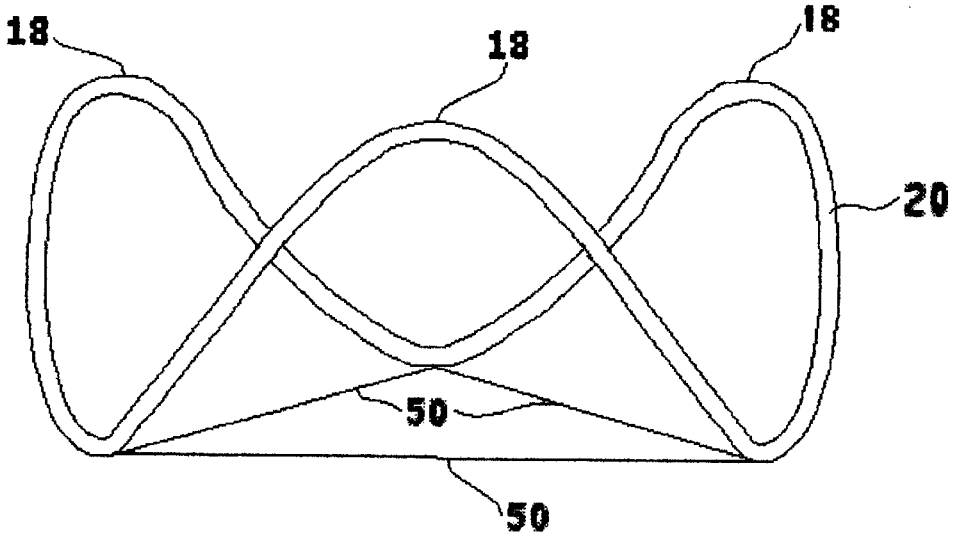
Figure 1B:
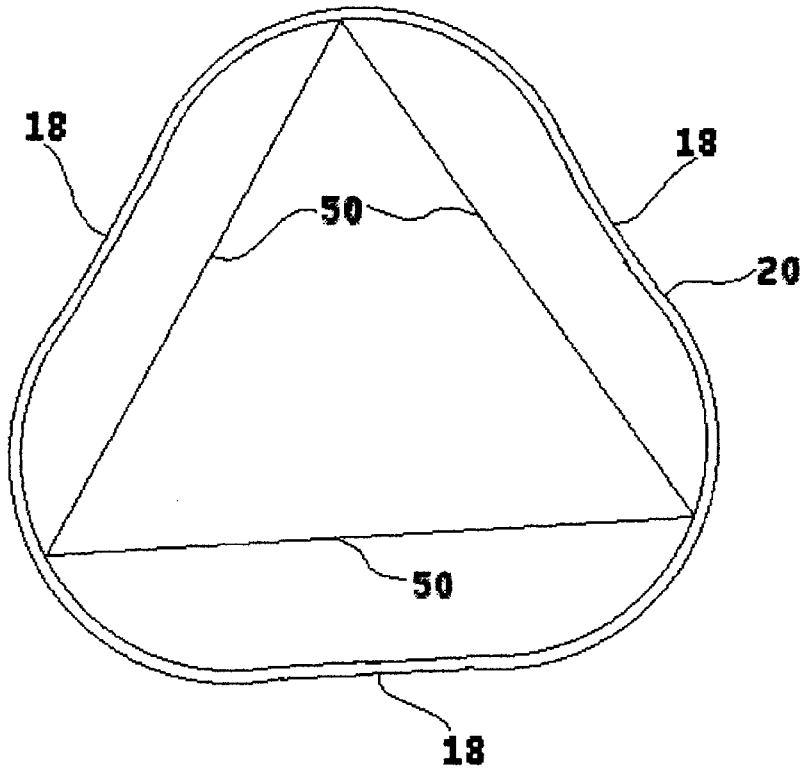
Figure 1C:
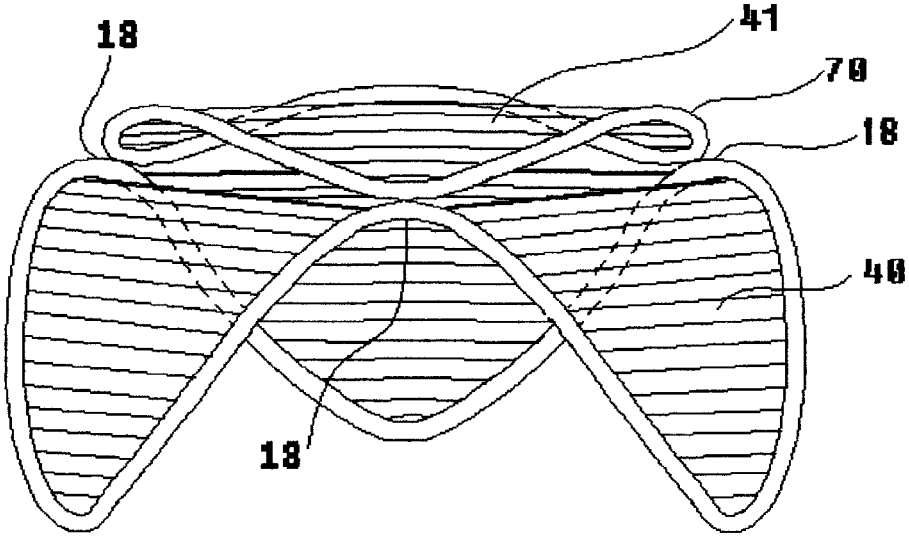
Figure 1C:
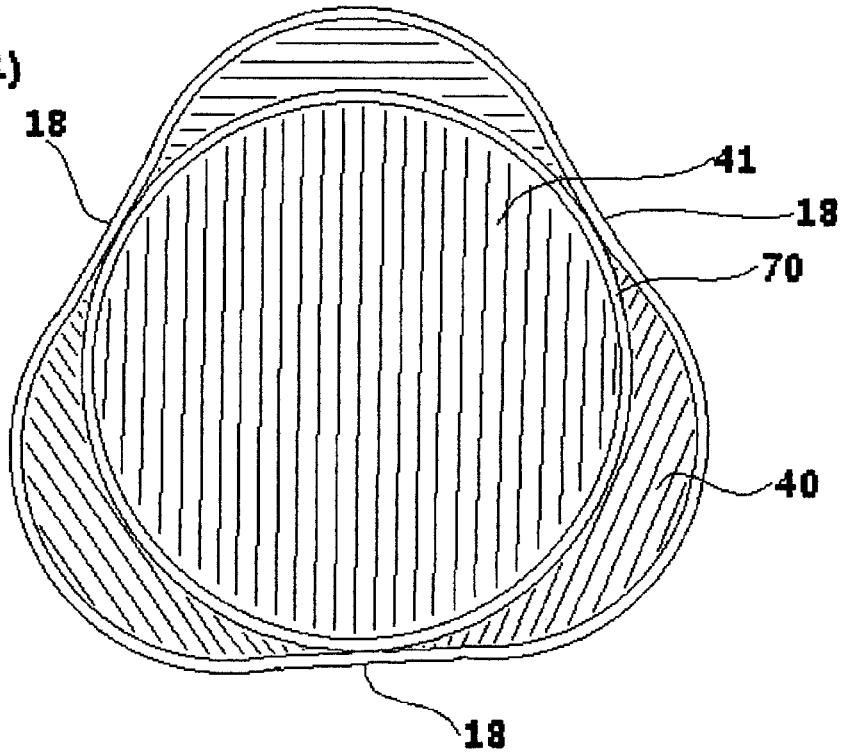
Figure 1D:
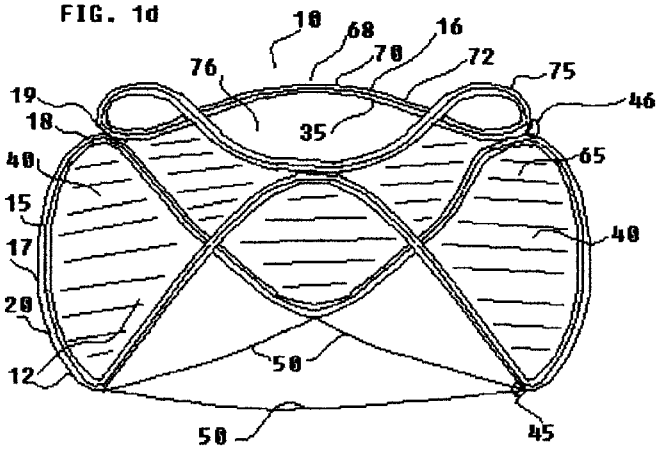
FIG. 1*d* is a perspective view of an embodiment of a collapsible tent according to the present invention shown in expanded configuration showing a closed loop distorted to form three tent support nooses and a separate closed loop distorted to form three hat support nooses.
Figure 1D:
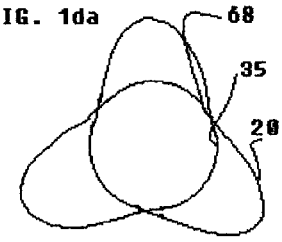
Figure 1D:
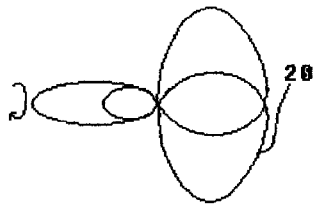
Figure 1D:
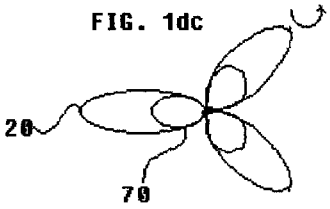
Figure 1D:
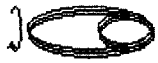
Figure 1D:
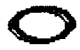

Referring to FIG. 1*d*, each tent support noose 20 also has a tent membrane 40 that is attached to at least a portion of the perimeter 17 of the tent support noose 20. The tent membrane 40 extends between the opposing portions of the tent support noose 20 to restrain the tent support noose 20. The tent membrane 40 or a separate hat membrane 41 may be shaped as an ellipse, oval, circular, rectangular, square, triangle and the like, other shapes are also possible as is recognized by practitioners in the art.

FIG. 1*a* shows three tent support nooses 20 with a tent membrane 40. A means for restraining 50 attached to at least a portion of the perimeter 17 of each support noose 20 is shown.

Preferably, each tent support noose 20 further comprises means for tightening 47 along at least a portion of its perimeter 17 to allow detaching the tent membrane 40 of the tent support noose 20 from a portion of the tent support noose 20. When the tent membrane 40 is fully attached to the tent support noose 20, it enhances the rigidity of the tent support noose 20 against twisting and bending. This is because the tent membrane 40 restrains the tent support noose 20 into a particular shape, which resists twisting and bending against the pull of the tent membrane 40 on the perimeter 17 of the tent support noose 20. By detaching at least a portion of the tent membrane 40 from the tent support noose 20, the rigidity of the tent support noose 20 is decreased and the tent support noose 20 can be easily twisted and bent to allow effortless folding of the tent support noose 20.

The means for tightening 47 can include detachable fasteners such as a zipper extending along a portion of the perimeter 17 of the tent support noose 20 and the tent membrane 40. The fasteners can also include hook and loop materials such as Velcro ™, snaps, buttons, straps or grommets. Preferably the fasteners are weather resistant to prevent leakage of water and the like into the tent through the fasteners. When the tent support noose 20 are rotated and placed on top of one another, the tent support nooses 20 can be collectively twisted and bent along the same points on their perimeter 17 in order to easily fold the collapsible tent 10 by collectively coiling the tent support nooses 20. Typically, the tent support nooses 20 can be collectively coiled into three overlapping rings.

The collapsible tent 10 further comprises a means for restraining 50 attached to at least a portion of the perimeter 17 of each support noose 20 and extending between the tent support nooses 20 to restrain the tent support nooses 20 in relation to one another. A means for attachment 45 between the means for restraining 50 and the tent support nooses 20 allows convenient detaching of the means for restraining 50 from the tent support nooses 20. The length of the means for restraining 50 defines the spacing of the tent support nooses 20 in relation to one another and the height of the collapsible tent 10 when the collapsible tent 10 is expanded. This is because without the means for restraining 50 the tent support nooses 20 assume a spatial position with respect to one another, such as a planar form, with minimum potential energy stored in the resilient tent member 15. In the embodiment of the collapsible tent 10 shown in FIG. 1, a cord is shown as the means for restraining 50. The means for restraining 50 is sized and shaped such that the tent support nooses 20 are in symmetrical spaced relation to one another and are restrained in relation to one another by the means for restraining 50. The means for restraining 50 may be a cord, line, wire, strap, tie, pole, membrane or other similar means. When in the assembled position the means for restraining 50 restrains the support loop tent membranes 40 so that the support loop tent membranes 40 define walls 65 of the collapsible tent 10. A net fabric may also form a portion of the walls or entrance of the tent and serve to keep bugs out and increase the airflow to the interior of the tent.

The collapsible tent 10 may include a collapsible hat 68. A hat member 70 may be a continuous part of the tent support nooses 20 thus defining a closed loop resilient coilable continuous member 71. Alternately, the hat member 70 can be formed by a second closed loop resilient coilable hat member 16 thus creating a separate hat member 70. FIG. 1 shows a separate hat member 70 which defines the collapsible hat 68. The hat member 70 can be distorted to form hat support nooses 75 as shown in FIG. 1*d*. When the collapsible hat 68 is a separate closed loop coilable hat member 70, then the second perimeter 72 of the hat member 70 approximately sits above the common adjoining tent region 35 that intersects with the perimeter 17 of each of the tent support nooses 20. Attached to the hat support loops 75 is a hat membrane 41. The hat membrane 41 may be continuous or separated in one or more portions. The tent membrane 40 may be extended to cover the separate closed loop coilable hat member 70 or the closed loop resilient coilable continuous member 71, thus avoiding the requirement of a separate hat membrane 41. The coilable hat member 70 can be distorted to form one or more hat support nooses 75.

The collapsible hat 68 also functions as a roof 76 of the collapsible tent 10 with the support loop tent membranes 40 defining walls 65 of the collapsible tent 10. The hat member 70 when necessary may be attached to the tent support nooses 20 by a second means of attachment 46, similar to the means of attachment 45, such as zipper, hook, tie, snap, Velcro or other methods known to practitioners of the trade. When the hat member 70 is distorted a center area 80 is formed. Although not all are shown, the center area 80 may take a variety of geometric shapes including; square, triangle, diamond, circle, and a point. As such, the present invention provides a self-erecting freestanding collapsible tent 10 with one or more resilient member 15, 16, which does not require any assembly by a user.

Preferably, the collapsible tent 10 further comprises means for attachment 45 between the means for restraining 50 and the tent support nooses 20 to allow detaching the means for restraining 50 from a portion of each tent support noose 20 to unrestrain the tent support nooses 20 in relation to one another. When the means for restraining 50 is fully attached to the tent support nooses 20, it enhances the rigidity of the tent support nooses 20 in relation to each other against twisting and bending. This is because the means for restraining 50 restrains the tent support nooses 20 into a particular spatial arrangement that resists twisting and bending against the pull of the means for restraining 50 on the perimeters 17 of the tent support nooses 20. By detaching at least a portion of the means for restraining 50 from the tent support nooses 20, the tent support nooses 20 can be easily twisted and bent to allow effortless folding of the tent support nooses 20. The means for attachment 45 can comprise a hook, snap, tie, or other means as described above.

The tent membranes 40 can be of canvas, duck or lightweight material suitable for privacy and wind or rain protection as recognized by practitioners in the art. Although not shown, openings in the tent membranes 40 forming the walls 65 of the collapsible tent 10 can be provided to serve as windows of the collapsible tent 10. The resilient member 15 is a coilable material with sufficient flexibility to allow distortion into the tent support nooses 20. The resilient member 15 can be a sheet or spring steel stock covered by a sleeve. Such material tends to resiliently urge itself back towards its resting position, which in the case of the tent support nooses 20 is elliptical shapes. To erect the tent 10, the coiled tent 10 is released from its carrying case and upon release the collapsible tent 10 self-erects into the form shown in FIG. 1. Although not shown zippers can be added along the support loop tent membranes 40. When collapsing the collapsible tent 10, the zippers along the support loop tent membranes 40 are unzipped and the tent support nooses 20 are rotated along the common adjoining tent region 35 and placed on top of one another along their perimeters 17 in a planar form. The tent support nooses 20 are then collectively twisted and bent along the same points on their perimeters 17 into a coil preferably having three turns. The coil is stable for handling such as placement inside a carrying case shaped and sized to receive the coil and snugly fit around the coil.

The length and thickness of the resilient coil member 15 depends on the shape and volume of the collapsible tent 10. For a larger tent, the resilient member 15 is longer and thicker to provide a larger support structure and to maintain the structural integrity of the tent 10.

The common adjoining tent region 35 may take the shape of an ellipse, square, circle, diamond, triangle or other shapes. The tent support nooses 20 are shown in the drawings in a configuration of three, four, five and six tent support nooses 20, although greater numbers are possible.

FIG. 1*a* shows three tent support noose 20 with a tent membrane 40. A means for restraining 50 attached to at least a portion of the perimeter 17 of each support noose 20 is shown. There is not a separate hat member 70, nor a separate common adjoining region loop member 36, so the area encompassed by the intersection of the high points 18 approximately defines the boundary 19 of the common adjoining tent region 35. FIG. 1*b* shows the same arrangement without the tent membrane 40. FIG. 1*c* adds a hat member 70 that is distorted so that it does not take a flat planar form. The hat member 70 has a separate hat membrane 41. FIG. 1*c*(2) shows a common adjoining region loop member 36 that does take a flat planar form and is secured within the tent membrane 40. There is no separate hat membrane 41 when the common adjoining region loop member 36 is used, as the common adjoining region loop member 36 is secured within the tent membrane 40. Once again, the area encompassed by the intersection of the high points 18 approximately defines the boundary 19 of the common adjoining tent region 35.

FIGS. 1*da* through 1*de* show the collapsing and folding of collapsible tent 10 including the coilable hat member 70. FIG. 1*d* illustrates a fully unfolded position with the hat member 70 forming an elliptical shape or substantially a circle. FIG. 1*db* shows one of the tent support nooses 20 and the hat member 70 twisted once into a smaller configuration. FIG. 1*dc* shows the remaining two tent support nooses 20 and hat member 70 twisted once into a smaller configuration. FIG. 1*dd* shows the three partially folded tent support nooses 20 and hat 70 having been folded upon each other. FIG. 1*de* shows the collapsible tent 10 being folded a final time into a small coiled loop configuration.

Figure 2:
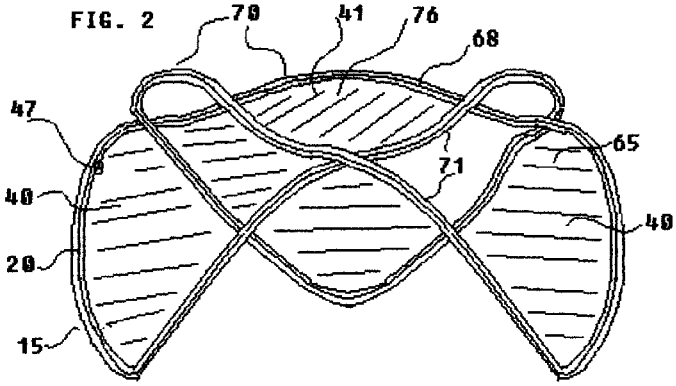
FIG. 2 shows a continuous closed loop distorted to form three tent support nooses and distorted to form three hat support nooses.
Figure 2A:
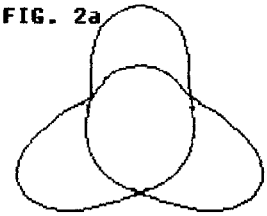
FIGS. 2*a* though FIG. 2*e* show the steps for coiling of the loops and nooses for storage.
Figure 2B:
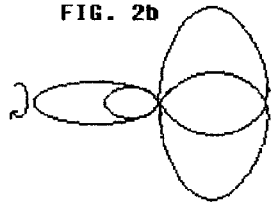
Figure 2C:
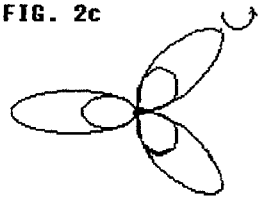
Figure 2D:
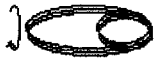
Figure 2E:
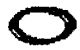

FIG. 2 illustrates the same arrangement as FIG. 1 except that the hat member 70 is a continuous part of the tent support nooses 20. The collapsible tent 10 is formed from a single coilable continuous member 71.

Figure 3:
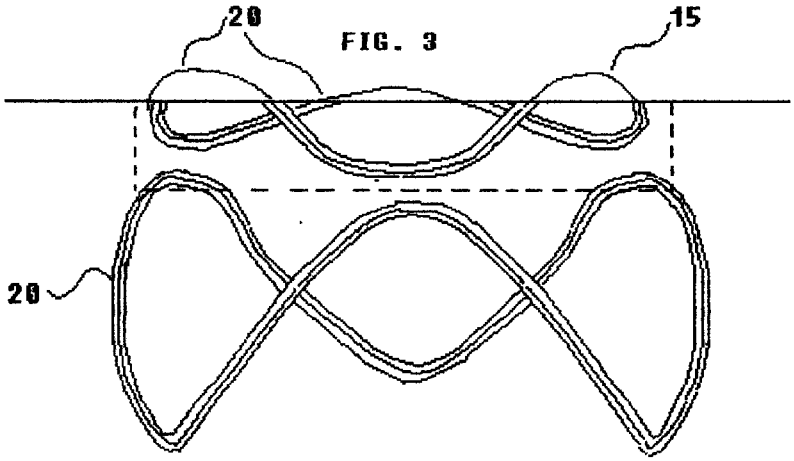
FIG. 3 shows a closed loop distorted to form three tent support nooses and a separate closed loop distorted to form three hat support nooses.
Figure 3A:
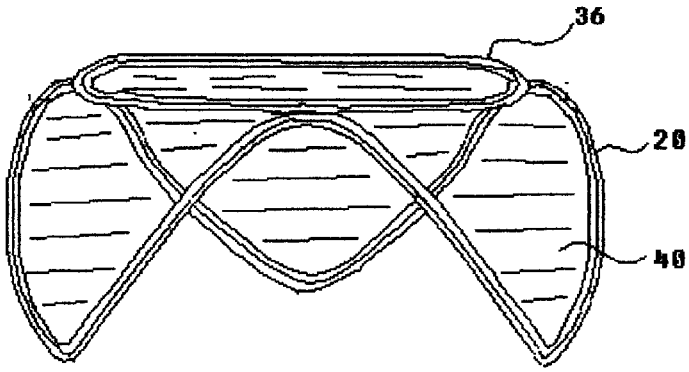
FIGS. 3*a* though FIG. 3*d* show the steps for coiling of the loops for storage.

FIG. 3 illustrates a fully unfolded position with the tent support nooses 20 being twisted to form three tent support nooses 20. A top view of the configuration is also illustrated. FIG. 3*a* illustrates a fully unfolded position of the collapsible tent 10 with the common adjoining region loop member 36. The common adjoining region loop member 36 takes substantially an extended elliptical shape.

Figure 3B:
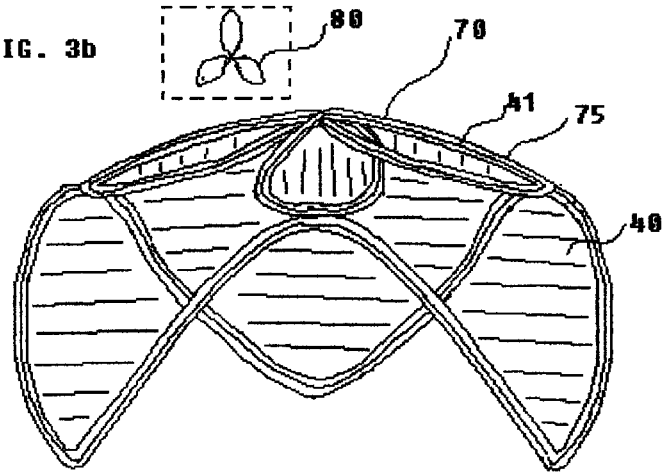
FIG. 3*b* shows a perspective view of a closed loop distorted to form three tent support nooses and a separate closed loop distorted to form three hat support nooses with the center area forming an apex point.

FIG. 3*b* shows the center area 80 that forms a single apex point. The hat member 70 is twisted and distorted to form three hat support nooses 75.

Figure 3C:
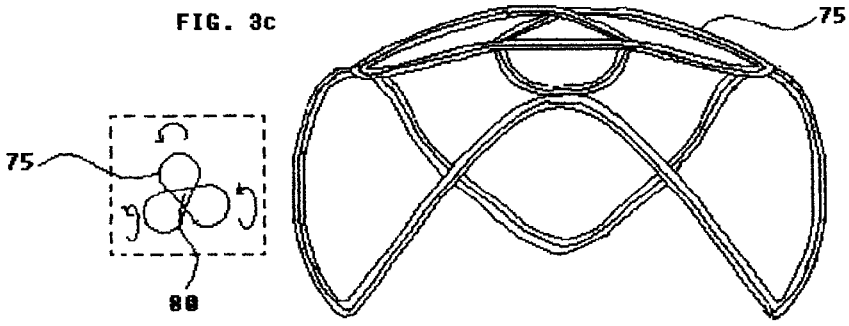
FIG. 3*c* shows a perspective view of a closed loop distorted to form three tent support nooses and a separate closed loop distorted to form three hat support nooses with the center area forming a triangle.

FIG. 3*c* is similar to FIG. 3*b*, wherein, the hat support nooses 75 when twisted form a center area 80 that takes a triangular shape. The center area 80 intersects the remainder of each hat support noose 75 along one side of the triangular center area 80.

Figure 3D:
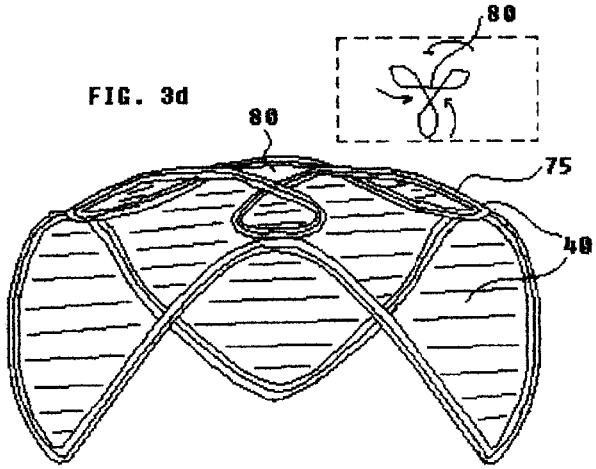
FIG. 3*d* shows a perspective view of a closed loop distorted to form three tent support nooses and a separate closed loop distorted to form three hat support nooses with the center area forming another variation of a triangle.
Figures 1, 3D:
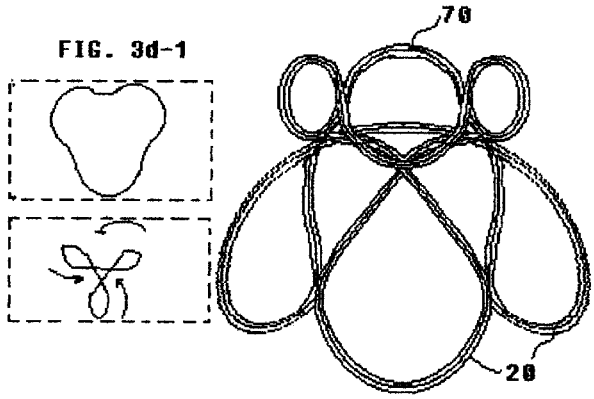
FIGS. 6*c*-1 though
Figures 1A, 3D:
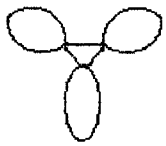
Figures 1B, 3D:
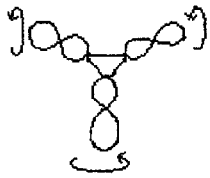
Figures 1C, 3D:
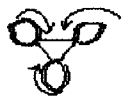
Figures 1D, 3D:
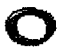

FIG. 3*d* is similar to FIG. 3, but shows a hat member 70 that is distorted to form three hat support noose 75. The center area 80 forms a triangle. The center area 80 intersects the remainder of each hat support noose 75 along one point of the triangular center area 80.

FIG. 3*d*-1 illustrates a partially folded position with the hat member 70 and the tent support nooses 20 aligned in a plane. FIG. 3*d*-1*b* shows one of the tent support nooses 20 and the hat member 70 twisted once into a smaller configuration. FIG. 3*d*-1*c* shows the remaining two tent support nooses 20 and hat member 70 twisted once into a smaller configuration. FIG. 3*d*-1*d* shows the three partially folded tent support nooses 20 and hat 70 having been folded upon each other a final time into a small coiled loop configuration.

Figure 4:
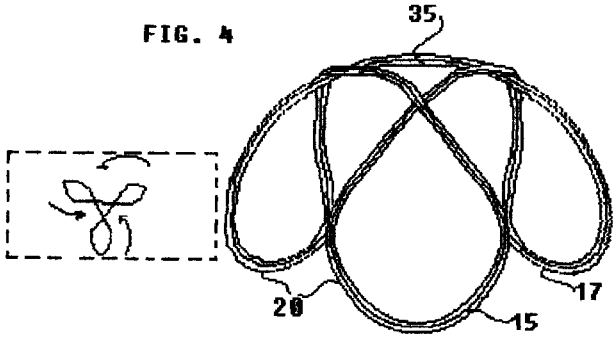
FIG. 4 shows a closed loop distorted to form three tent support.
Figure 4A:
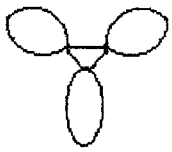
FIGS. 4*a* though FIG. 4*d* show the steps for coiling of the loops and nooses for storage.
Figure 4B:
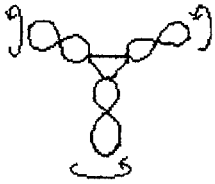
FIG. 4*e* shows a closed loop distorted to form four tent support nooses and a separate closed loop distorted to form four hat support nooses.
FIGS. 4*f* though FIG. 4*k* show the steps for coiling of the loops and nooses for storage.
Figure 4C:
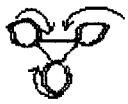
Figure 4D:
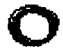

Referring to FIG. 4 the resilient tent member 15 is distorted to form three tent support nooses 20. Each support noose 20 adjoins the other tent support nooses 20 along its perimeter 17. The tent support nooses 20 are substantially elliptical in shape. The tent support nooses 20 are distorted and twisted such that each tent support nooses 20 overlaps itself thus forming a common adjoining tent region 35 that takes the shape of a triangle. There is not a separate hat. FIGS. 4*a*-4*d* show the steps for coiling.

Figure 4E:
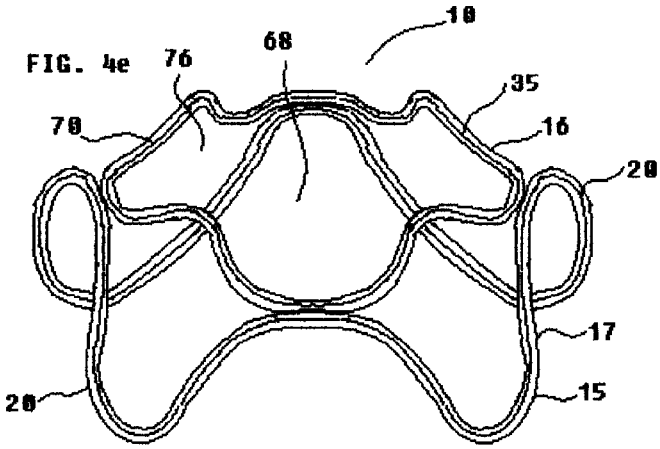
Figure 4F:
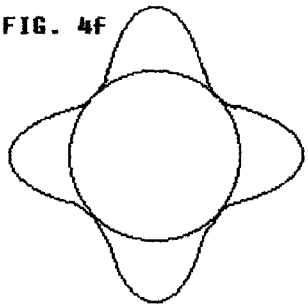
Figure 4G:
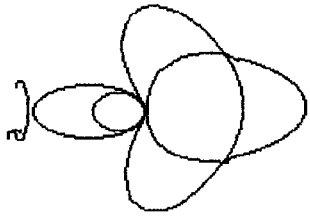
Figure 4I:
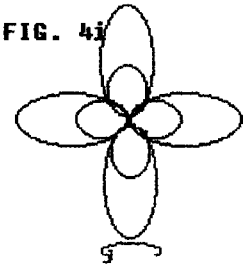
Figure 4H:
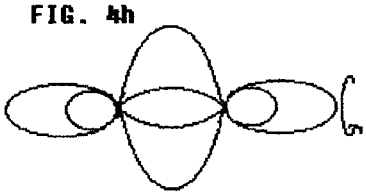
Figure 4J:
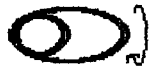
Figure 4K:
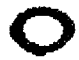

Referring to FIG. 4*e* there is shown another embodiment of a collapsible tent 10 according to the present invention, the resilient tent member 15 is distorted to form four tent support nooses 20. Each support noose 20 adjoins the other tent support nooses 20 along its perimeter 17. The tent support nooses 20 are substantially elliptical in shape and have a common adjoining tent region 35. The hat 68 is defined by a separate second resilient hat member 70. The hat member 70 forms the common adjoining tent region 35 that intersects with the perimeter 17 of each of the tent support nooses 20 and also forms a roof 76 of the collapsible tent 10. The hat member 70 is raised higher than the tent support nooses 20 in four areas equally space around the common adjoining tent region 35. FIGS. 4*f*–4*k* show the steps for coiling.

Figure 5:
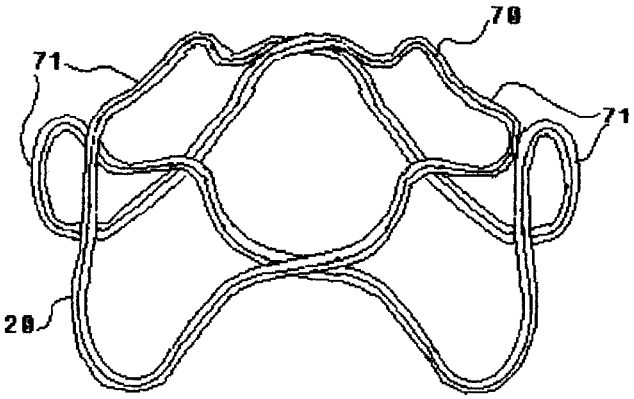
FIG. 5 shows a continuous closed loop distorted to form four tent support nooses and distorted to form four hat support nooses.
Figure 5A:
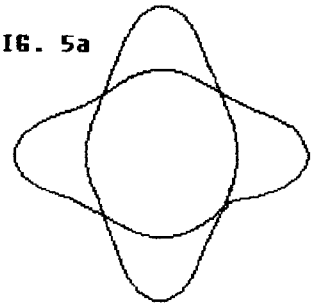
FIGS. 5*a* though FIG. 5*f* show the steps for coiling of the loops and nooses for storage.
Figure 5B:
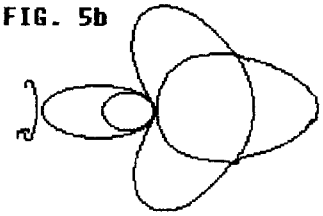
Figure 5C:
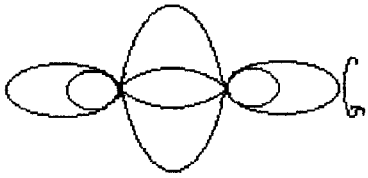
Figure 5D:
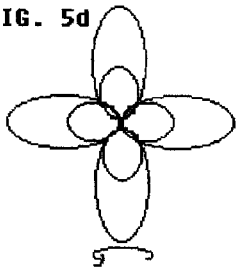
Figure 5E:
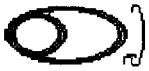
Figure 5F:
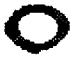

FIG. 5 is similar to FIG. 4, except that the hat member 70 is a continuous part of the tent support nooses 20. The collapsible tent 10 is formed from a single coilable continuous member 71.

Figure 6:
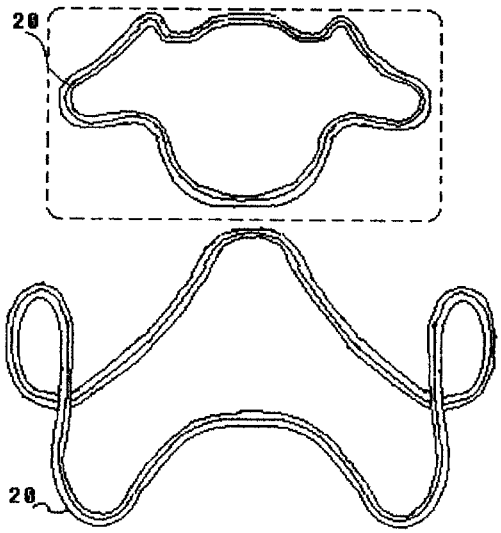
FIG. 6 shows a closed loop distorted to form four tent support nooses and a separate closed loop distorted to form four hat support nooses.
Figure 6A:
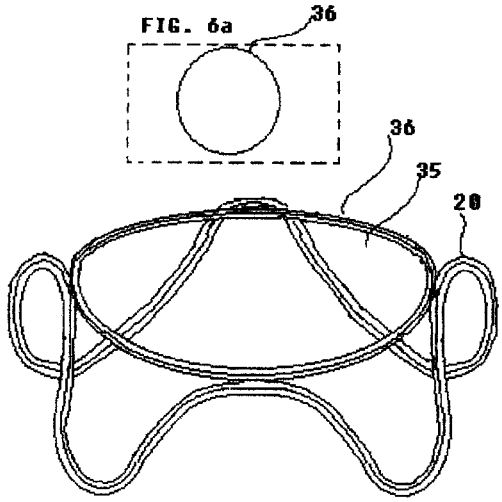
FIG. 6*a* illustrates the common adjoining region loop member in the form of a circle.
Figure 6B:
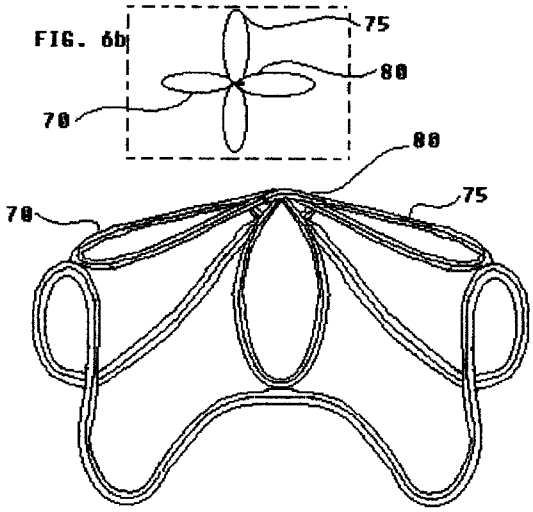
FIG. 6*b* illustrates the hat in the form of four nooses meeting at a single point.
Figure 6C:
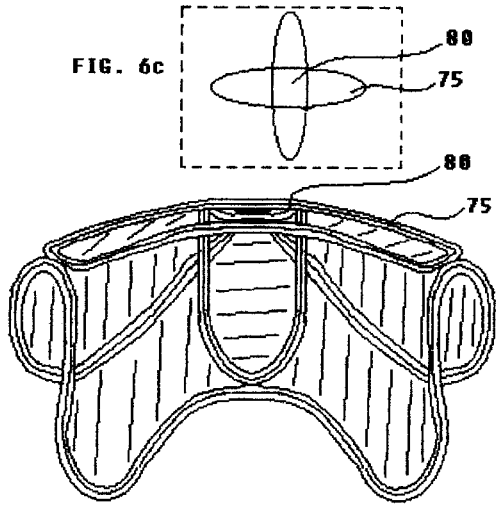
Figures 1, 6C:
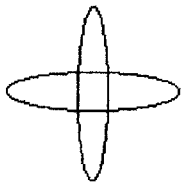
Figures 2, 6C:
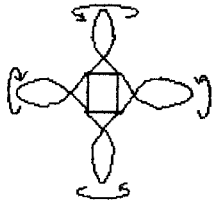
Figures 3, 6C:
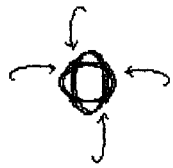

Referring to FIGS. 6 through 6*c* various embodiments are shown of the hat 68 from the initial configuration of FIG. 4. FIG. 6 shows tent support nooses 20 similar to FIG. 4, but without a hat; with also a top view depiction of the tent support nooses 20.

FIG. 6*a* is shown with a common adjoining region loop member 36 as a planar circle, which is level with the highest point of the tent support loops 20. FIG. 6*b* shows the hat member 70 being twisted to form four hat support nooses 75. The hat support nooses 75 when twisted form a center area 80 that is a single point.

Figure 6D:
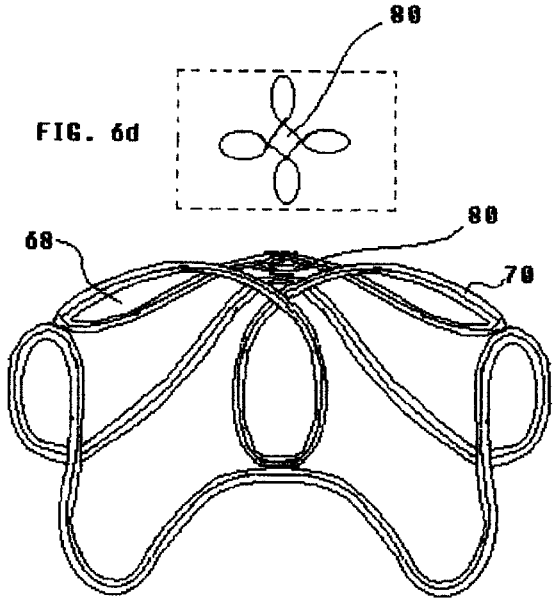
FIG. 6*d* illustrates the hat in the form of four nooses meeting at a diamond shape.

FIG. 6*c* shows the hat member 70 being twisted to form four hat support nooses 75. The hat support nooses 75 when twisted form a center area 80 that takes the shape of a square. The center area 80 intersects the remainder of each hat support noose 75 along one side of the square center area 80. FIG. 6*d* is similar to FIG. 6*c*, except that it illustrates an embodiment where the center area 80 of the collapsible hat 68 is diamond shape.

Figure 7:
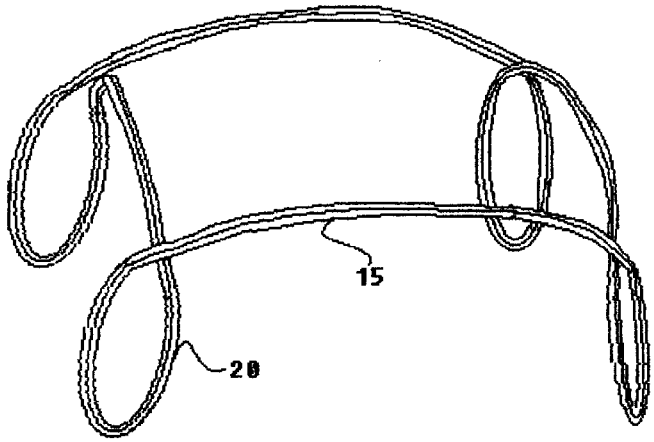
FIG. 7 shows the closed loop resilient member being twisted to form four small tent support nooses.
Figure 7A:
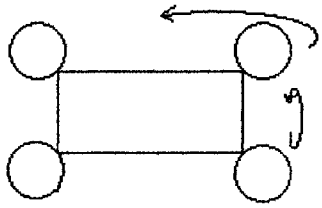
FIGS. 7*a* though FIG. 7*d* show the steps for coiling of the loops and nooses for storage.
Figure 7B:
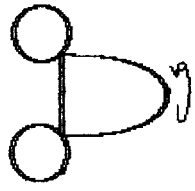
Figure 7C:
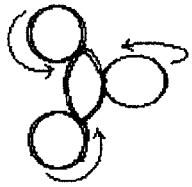
Figure 7D:
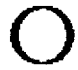

FIG. 7 shows the resilient tent member 15 being twisted to form four tent support nooses 20. In this configuration the tent support nooses 20 cross over along a portion of the perimeter 17. The tent support nooses 20 are small in relation to the remaining perimeter 17 distance that separates them. There is no separate hat in this arrangement.

Figure 8:
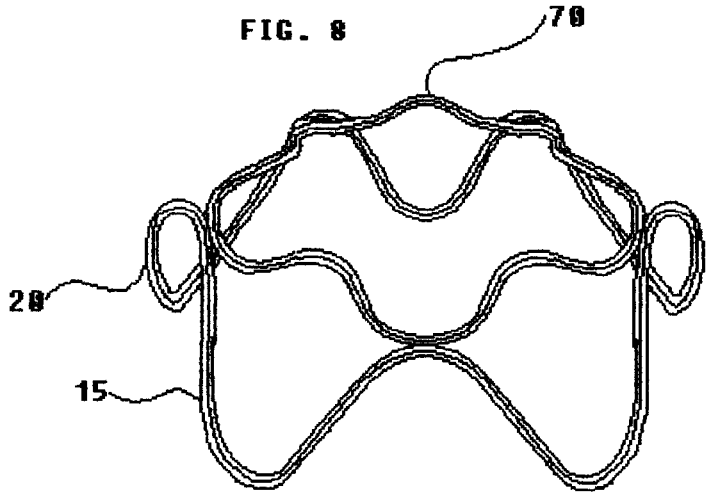
FIG. 8 is a side perspective view depicting the resilient member being twisted to form five tent support nooses.
Figure 8A:
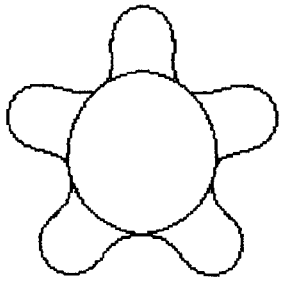
FIGS. 8*a* though FIG. 8*d* show the steps for coiling of the loops and nooses for storage.
Figure 8B:
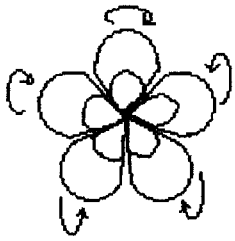
Figure 8C:
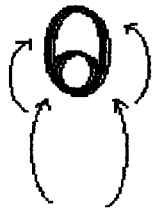
Figure 8D:
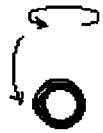

FIG. 8 depicts resilient tent member 15 being twisted to form five tent support nooses 20. The hat member 70 is formed by a second resilient coilable member 16. The hat member 70 is distorted to create four raised portions and four dips.

Figure 9:
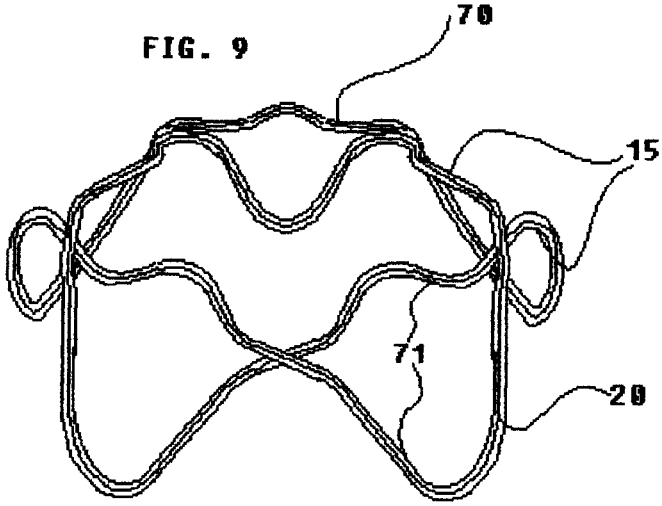
FIG. 9 is a side perspective view depicting the resilient member as a single continuous resilient member.
Figure 10:
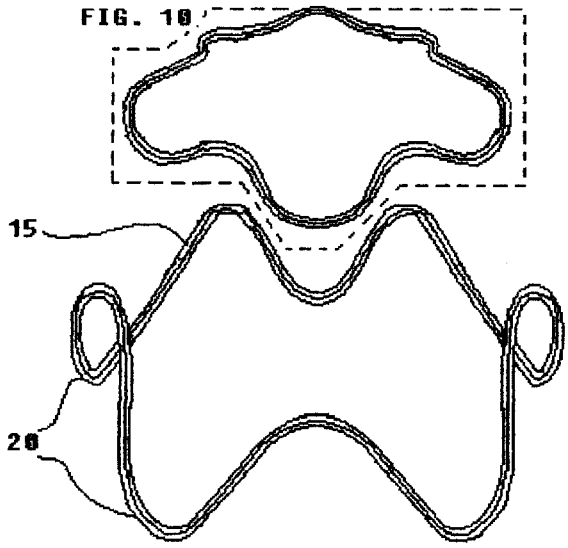
FIG. 10 is a side perspective view similar to FIG. 8, except that no hat member is shown.
Figure 10A:
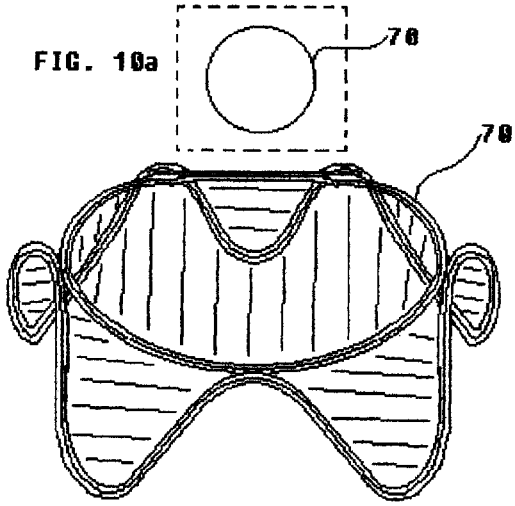
FIG. 10*a* is a side perspective view with a hat member that forms a substantially circular shape.
Figure 10B:
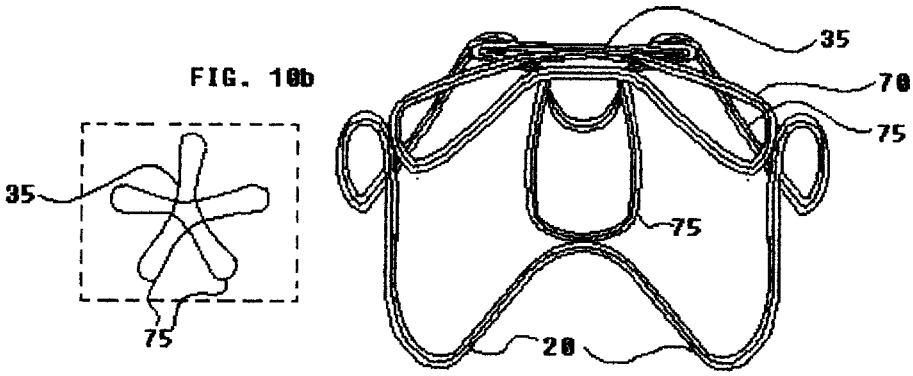
FIG. 10*b* is a side perspective view with the hat member forming a pentagon at its apex.

FIG. 9 is the same configuration as FIG. 8 except that the tent support nooses 20 and the hat member 70 are formed by a single resilient continuous member 71. FIG. 10. is similar to FIG. 8, except that no hat member 70 is shown. FIG. 10 depicts resilient tent member 15 being twisted to form five tent support nooses 20. FIG. 10*a* adds a hat member 70 that forms a substantially circular shape. FIG. 10*b* shows a hat member 70 that is distorted to form five hat support nooses 75. The hat support loops 75 form a common adjoining tent region 35 that takes substantially a pentagon shape.

Figure 11A:
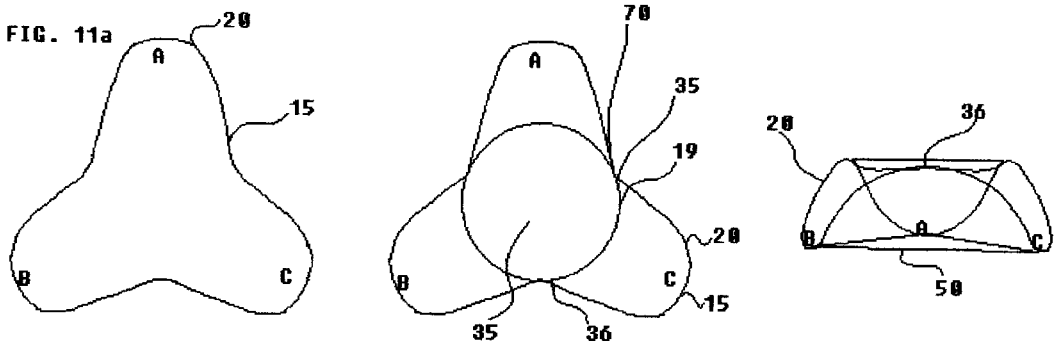
FIGS. 11*a*–11*d* show perspective views and top views of the tent support nooses in the configuration of three support nooses through six support nooses.

Referring to FIG. 11*a* there is shown the resilient tent member 15 being twisted to form three tent support nooses 20. There are three depictions, first a top view of just the three tent support nooses 20 in a design without a hat member, second a top view of the three tent support nooses 20 and the hat member 70, and finally a side view of the three tent support nooses 20 and the hat member 70. The hat member 70 is flat and planar, thus it approximates the boundary 19 of the common adjoining tent region 35. The means for restraining 50 attaches to the tent support nooses 20 thereby restraining the tent support nooses 20 and providing them an upright shape. The common adjoining tent region 35 takes the shape of a circle, although other variations are possible. As previously described the hat member 70 may be a continuation of the tent member 15 or a separate coilable member. Also there may be a continuous tent membrane 40 or additionally a separate hat membrane 41.

Figure 11B:
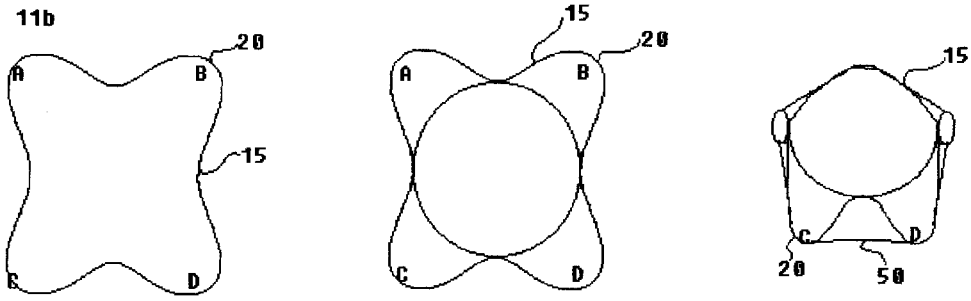
Figure 11C:
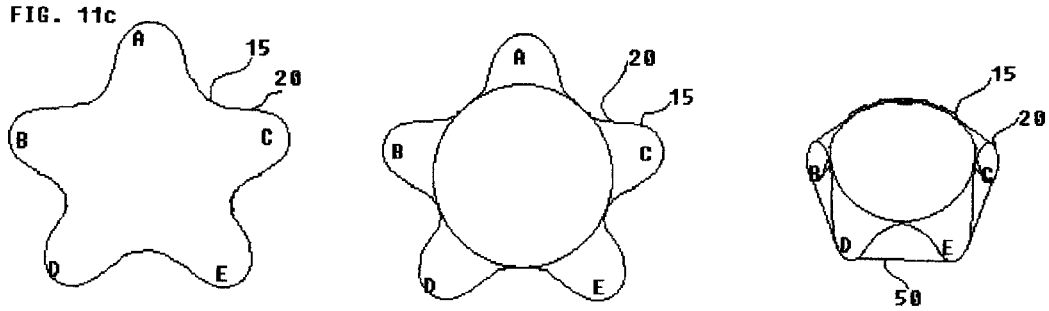
Figure 11D:
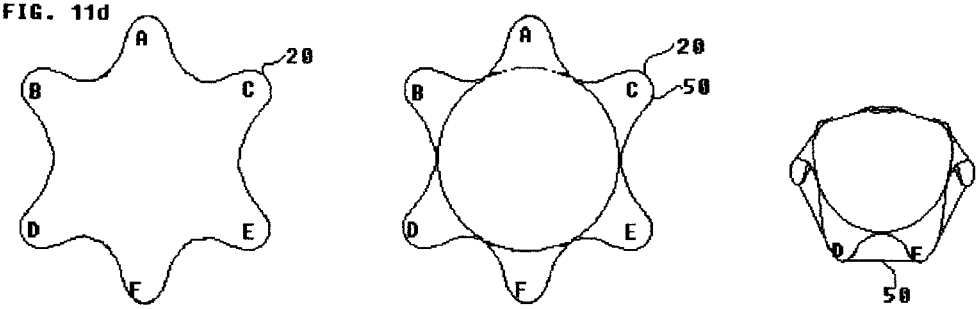

FIG. 11*b*, FIG. 11*c*, and FIG. 11*d* show the resilient tent member 15 being twisted to form four, five or six tent support nooses 20. FIG. 11*b* through FIG. 11*d* are similar to FIG. 11*a* in other aspects.

Although the present invention has been described in considerable detail with regard to the preferred versions thereof, other versions are possible. Therefore, the appended claims should not be limited to the descriptions of the preferred versions contained herein.

What is claimed is:

1. A collapsible tent comprising:

a) a tent member comprising a closed loop resilient coilable tent member, the tent member being distorted to form at least three tent support nooses, each tent support noose adjoining the other tent support nooses along at least a portion of its perimeter, each tent support noose having a perimeter substantially the same as that of the other tent support nooses;

b) a tent membrane attached to at least a portion of the perimeter of the tent support noose and extending between the opposing portions of the tent support noose to restrain the tent support noose; and c) a common adjoining tent region having a boundary defined approximately by intersecting or joining the high point of each tent support noose;

wherein the common adjoining tent region is substantial in area and the common adjoining tent region is covered by the tent membrane.

2. The collapsible tent of claim 1 further comprising a means for restraining attached to at least a portion of the perimeter of each tent support noose and extending between the tent support nooses to restrain the tent support nooses in relation to one another.

3. The collapsible tent of claim 2 wherein the tent member is distorted to form six support nooses.

4. The collapsible tent of claim 2 wherein the tent member is distorted to form five support nooses.

5. The collapsible tent of claim 2 wherein the tent member is distorted to form four support nooses.

6. The collapsible tent of claim 1 wherein the tent support nooses are further distorted so that a portion of the tent support nooses follow the boundary of the common adjoining tent region.

7. A collapsible tent comprising:

a) a tent member comprising a closed loop resilient coilable tent member, the tent member being distorted to form at least three tent support nooses, each tent support loop adjoining the other tent support nooses along at least a portion of its perimeter, each tent support noose having a perimeter substantially the same as that of the other tent support nooses and a tent membrane attached to at least a portion of the perimeter of the tent support noose and extending between the opposing portions of the tent support noose to restrain the tent support noose; and b) a common adjoining tent region loop member comprising a separate closed loop resilient coilable member, the common adjoining tent region loop member forming a common adjoining tent region for the tent support nooses;

wherein the common adjoining tent region loop member is flat and planar substantially taking the form of a circle, rectangle, square, triangle or oval shape and is secured within the tent membrane.

8. The collapsible tent of claim 7 further comprising a means for restraining attached to at least a portion of the perimeter of each tent support noose and extending between the tent support nooses to restrain the tent support nooses in relation to one another.

9. The collapsible tent of claim 8 wherein the tent member is distorted to form six support nooses.

10. The collapsible tent of claim 8 wherein the tent member is distorted to form five support nooses.

11. The collapsible tent of claim 8 wherein the tent member is distorted to form four support nooses.

12. A collapsible tent comprising:

a) a tent member comprising a closed loop resilient coilable tent member, the tent member being distorted to form at least three tent support nooses, each tent support noose adjoining the other tent support nooses along at least a portion of its perimeter, each tent support noose having a perimeter substantially the same as that of the other tent support nooses and a tent membrane attached to at least a portion of the perimeter of the tent support noose and extending between the opposing portions of the tent support noose to restrain the tent support noose; and b) a hat member comprising a closed loop resilient coilable hat member, and a hat membrane attached to at least a portion of the perimeter of the hat member, the hat member further comprising a means for attachment to at least a portion of the perimeter of the hat member and extending between the hat member and the tent support nooses to secure the hat member to the tent support nooses, the hat member forming a common adjoining tent region for the tent support nooses.

13. The collapsible tent of claim 12 further comprising a means for restraining attached to at least a portion of the perimeter of each tent support noose and extending between the tent support nooses to restrain the tent support nooses in relation to one another, whereby when the tent is expanded, the tent support nooses are in spaced relation to one another around the hat member and restrained by the means for restraining, the hat member forming a roof and the tent membranes of the tent support nooses defining walls of the tent.

14. The collapsible tent of claim 13 wherein the hat member is distorted to form a center area.

15. The collapsible tent of claim 13 wherein the center area forms about a square shape.

16. The collapsible tent of claim 13 wherein the hat member is substantially elliptical in shape.

17. The collapsible tent of claim 13 wherein the hat member is distorted to form three hat support nooses.

18. The collapsible tent of claim 13 further comprising a means for tightening of a tent membrane to a tent support noose.

19. The collapsible tent of claim 14 wherein the tent member is distorted to form six support nooses.

20. The collapsible tent of claim 14 wherein the tent member is distorted to form five support nooses.

21. The collapsible tent of claim 14 wherein the tent member is distorted to form four support nooses.

22. A collapsible tent comprising:

a) a tent member comprising a closed loop resilient coilable tent member, the member being distorted to form at least three tent support nooses, each tent support noose adjoining the other tent support nooses along at least a portion of its perimeter, each tent support noose having a perimeter substantially the same as that of the other tent support nooses and a tent membrane attached to at least a portion of the perimeter of the tent support noose and extending between the opposing portions of the tent support noose to restrain the tent support noose; and b) a hat member comprising a closed loop resilient coilable hat member, and a hat membrane attached to at least a portion of the perimeter of the hat member, the hat member further comprising a means for attachment to at least a portion of the perimeter of the hat member and extending between the hat member and the tent support nooses to secure the hat member to the tent support nooses, the hat member forming a common adjoining tent region for the tent;

wherein the tent member comprising a closed loop resilient coilable tent member and the collapsible hat comprising a closed loop resilient coilable hat member are continuous, thus forming a closed loop resilient coilable continuous member through out the collapsible tent.

23. The collapsible tent of claim 22 further comprising a means for restraining attached to at least a portion of the perimeter of each tent support noose and extending between the tent support nooses to restrain the tent support nooses in relation to one another, whereby when the tent is expanded, the tent support nooses are in spaced relation to one another around the hat member and restrained by the means for restraining, the hat member forming a roof and the tent membranes of the tent support nooses defining walls of the tent.

24. The collapsible tent of claim 23 wherein the common adjoining tent region substantially forms a circle.

25. The collapsible tent of claim 23 wherein when the tent is collapsed, the tent support nooses form over lapping loops over one another that can be coiled.

26. The collapsible tent of claim 23 wherein the tent member is distorted to form six support nooses.

27. The collapsible tent of claim 23 wherein the tent member is distorted to form five support nooses.

28. The collapsible tent of claim 23 wherein the tent member is distorted to form four support nooses.

* * * * *